US007588148B2

(12) United States Patent
Yang

(10) Patent No.: US 7,588,148 B2
(45) Date of Patent: Sep. 15, 2009

(54) PACKAGING STRUCTURE FOR FLAT PANEL DISPLAY

(75) Inventor: Chu-Fang Yang, Sinying (TW)

(73) Assignee: Hannspree, Inc., Taipei (TW)

( * ) Notice: Subject to any disclaimer, the term of this patent is extended or adjusted under 35 U.S.C. 154(b) by 265 days.

(21) Appl. No.: 11/650,931

(22) Filed: Jan. 9, 2007

(65) Prior Publication Data

US 2008/0112115 A1 May 15, 2008

(30) Foreign Application Priority Data

Nov. 13, 2006 (TW) ..... 95141866 A

(51) Int. Cl.
*B65D 81/02* (2006.01)

(52) U.S. Cl. ..... 206/523; 206/586; 206/592

(58) Field of Classification Search ..... 206/320, 206/453, 454, 521, 523, 586, 587, 591, 592, 206/525

See application file for complete search history.

(56) References Cited

U.S. PATENT DOCUMENTS

| | | | | |
|---|---|---|---|---|
| 5,385,232 | A * | 1/1995 | Foos et al. | 206/320 |
| 6,116,423 | A * | 9/2000 | Troxtell et al. | 206/523 |
| 6,666,334 | B2 * | 12/2003 | Fujii | 206/586 |
| 6,811,028 | B2 * | 11/2004 | Kim et al. | 206/587 |
| 2003/0209464 | A1 * | 11/2003 | Otsuka et al. | 206/586 |
| 2006/0219596 | A1 * | 10/2006 | Lin et al. | 206/592 |

* cited by examiner

*Primary Examiner*—Luan K Bui
(74) *Attorney, Agent, or Firm*—Bacon & Thomas PLLC

(57) ABSTRACT

The present invention discloses a packaging structure, which includes an external box, a lower box and cushions, for packing a display panel and a base of a flat panel display simultaneously, wherein the bottom of the lower box is provided for wrapping the top of the display panel, and the bottom of each cushion facing the display panel has a first containing groove, and the first containing grooves are provided for wrapping the bottom of the display panel, and these cushions at their top have two second containing grooves for wrapping the base. The invention not only packs the display panel and the base simultaneously into the packaging structure, but also reduces the volume of the packaging structure effectively.

2 Claims, 6 Drawing Sheets

PACKAGING STRUCTURE FOR FLAT PANEL DISPLAY

FIELD OF THE INVENTION

The present invention relates to a packaging structure, and more particularly to a packaging structure including an external box, a lower box and cushions for packing a display panel and a base of a flat panel display simultaneously into the external box, so as to reduce the volume of the packaging structure effectively.

BACKGROUND OF THE INVENTION

In recent years, various electronic products are introduced to the market constantly, and both function and quality of these products are developed rapidly to break through our purchasing habit. For example, a cathode ray tube (CRT) television comes with a large size and higher power consumption, and the CRT televisions cannot satisfy user requirements for easy carry, small installation space, and convenient transportation, and thus the CRT televisions are replaced gradually by flat panel televisions, particularly by liquid crystal display (LCD) televisions. Since the flat panel televisions feature lower power consumption, a low radiation, lighter weight, and a small volume occupying not much space, therefore the flat panel televisions become very popular and welcome by most consumers. The demand and market share of the LCD televisions grow unceasingly, and the cost of LCD panels drops continuously, and thus the LCD televisions gradually replace the traditional CRT televisions and become a mainstream of home video products.

As the manufacturing technologies of LCD television constantly have breakthrough, the original luxury LCD televisions have become one of the low-priced and high-performance electric appliances. Particularly, the selling price of LCD television keeps on dropping, and thus the -LCD televisions attract more and more attentions in the market, and now become the most popular digital home appliance. Since the sales volume of the large-size LCD televisions gradually rises, the problems for the package and transportation of the large size LCD televisions gradually emerge and become an important issue for manufacturers, sellers and consumers.

In general, an LCD television comprises a display panel and a base. When the LCD television is packed, a conventional package method is used to pack the whole assembly of the display panel and base into a carton before exiting factory or shipping to customers. However, the conventional package method results in a large volume of the carton, not only incurring a higher material cost of the carton, but also reducing the capacity of a single container for shipping the LCD televisions, and this conventional method further increases the transportation cost. Therefore, some manufacturers pack the display panel and the base separately, in hope of overcoming the foregoing shortcomings. Although such arrangement can reduce the volume of each carton, however the package cost is increased and the package time is extended. Furthermore, consumers need to spend more time to attach the base onto the display panel and the base after they purchase the LCD television, and thus greatly reducing the consumer's willingness of purchasing such product.

To improve the aforementioned two packing methods, some manufacturers developed a carton structure capable of simultaneously packing the display panel and the base as disclosed in R.O.C. Pat. No. M284649 entitled "Carton structure for liquid crystal display devices". In FIG. 1, the structure includes an external box 10, a lower buffer 11, a lateral buffer 12 and an upper buffer 13, wherein the lower buffer 11 is disposed at the bottom in the external box 10, and the bottom of the display panel 20 is wrapped in the lower buffer 11, and the upper buffer 13 is provided for wrapping the top of the display panel 20. After the external box 10 is closed, the upper buffer 13 is contained in the top of the external box 10, and the lateral buffer 12 is placed between the lower buffer 11 and the upper buffer 13 for wrapping the lateral sides of the display panel 20, and the base 22 is placed between the lateral buffer 12 and the upper buffer 13 by a latch groove 130 disposed on the upper buffer 13.

Although the foregoing carton structure can reduce the volume of the carton, such structure cannot effectively overcome the shortcomings of the conventional package methods, but it still causes problems. For instance, the display panel 20 cannot be erected on a tabletop after the display panel 20 is removed from carton, because the base 22 has not been installed on to the bottom of the display panel 20, and thus consumers may have difficulties to place the display panel 20. If the display panel 20 is not placed properly, the display panel 20 may be scraped or damaged. Furthermore, consumers usually lie the display panel 20 horizontally on a desktop or a floor, such that when consumers want to attach the base 22 onto the bottom of the display panel 20, consumers may damage the display panel 20 or the base 22, since it is difficult to apply forces when both display panel 20 and base 22 are set at poor disposing positions. As a result, unnecessary disputes between consumers and manufacturers may arise.

In addition, the foregoing carton structure uses too many large buffers 11, 12, 13, and these buffers 11, 12, 13 are usually made of a styrofoam, corrugated paper or foam material. Such arrangement not only increases the material cost, but also fails to meet the environmental protection requirement of consuming less packing materials. Therefore, it is an important issue for manufacturers to overcome the shortcomings of the prior art.

SUMMARY OF THE INVENTION

In view of the foregoing shortcomings of the conventional packaging structure for LCD television, the inventor of the present invention based on years of experience conducting extensive researches and experiments, and finally invented a packaging structure for flat panel display in accordance with the present invention.

Therefore, a primary objective of the present invention is to provide a packaging structure for simultaneously packing a display panel and a base of a flat panel display, and the packaging structure has an external box, and the top and bottom of the external box have a lower box and cushions, wherein the bottom of the lower box is provided for wrapping the top of the display panel, and the bottom of each cushion facing the display panel has a first containing groove, and these first containing grooves are provided for wrapping the bottom of the display panel, and the top of both cushions has two second containing grooves for wrapping the base. The invention not only packs the display panel and the base simultaneously into a single packaging structure, but also reduces the volume of the package structure effectively.

To make it easier for our examiner to understand the objective, technical characteristics and effects of the present invention, a preferred embodiment will be described with accompanying drawings as follows:

DETAILED DESCRIPTION OF THE PREFERRED EMBODIMENTS

Figure 1:
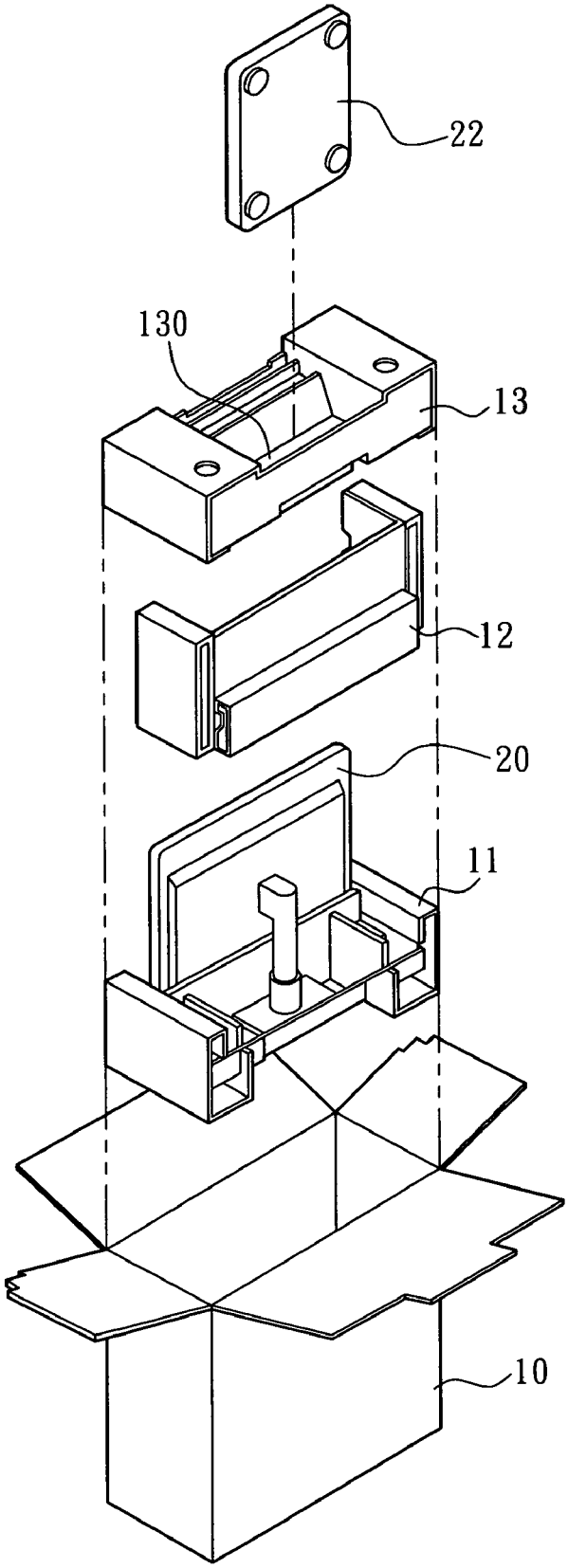
FIG. 1(Prior Art)
FIG. 1 is an exploded view of a conventional packaging box structure for LCD.
Figure 2:
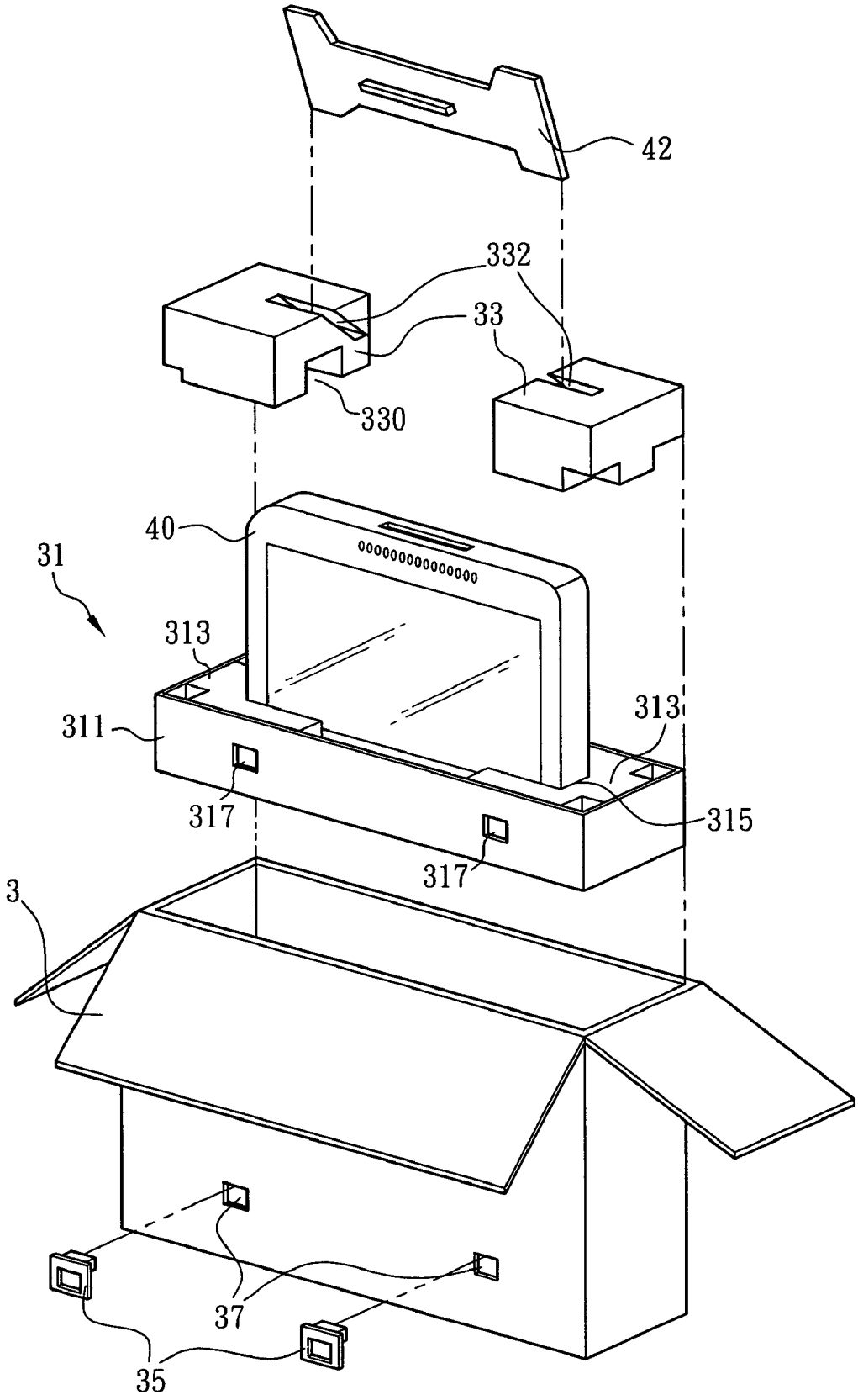
FIG. 2 is an exploded view of a packaging structure with a flat panel display of the present invention.
Figure 3:
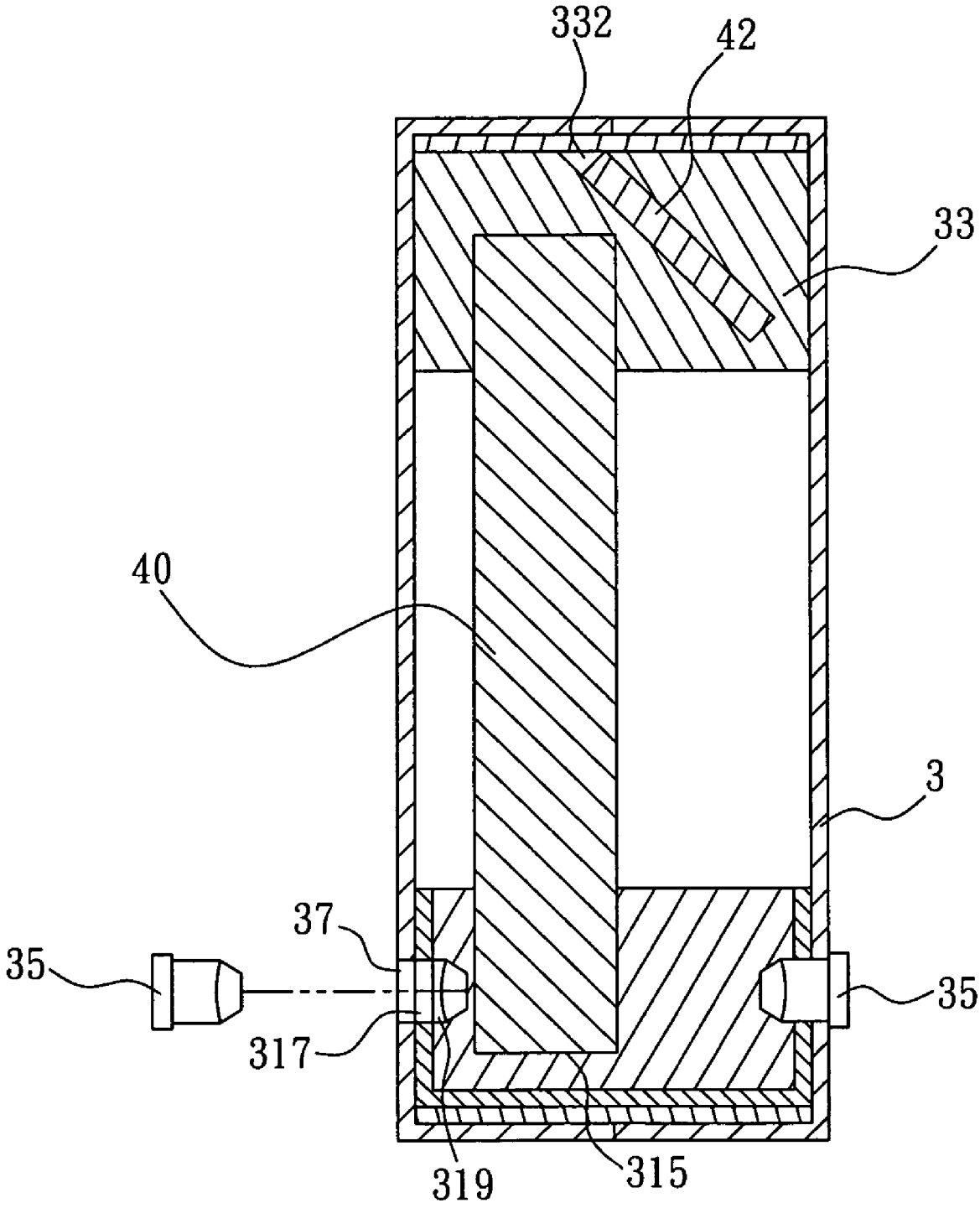
FIG. 3 is a cross-sectional view of a flat panel display and a packaging structure of the present invention.

Referring to FIGS. 2 and 3 for a packaging structure of the present invention for packing a flat panel display, the packaging structure comprises an external box 3, a lower box 31 and two cushions 33 for packing a display panel 40 and a base 42 of the flat panel display simultaneously. The lower box 31 is disposed at the bottom in the external box 3, and the bottom of the lower box 31 is provided for wrapping the top of the display panel 40 and preventing the top of the display panel 40 from being hit or collided. The two cushions 33 are installed at the top in the external box 3, and each cushion 33 has a first containing groove 330 and a second containing groove 332. The two first containing grooves 330 are disposed at the bottom of the two cushions 33 and covered onto the bottom of the display panel 40 for preventing the bottom of the display panel 40 from being hit or collided and keeping the display panel 40 at a position with an interval from the two cushions 22 and the external box 3 by the lower box 31, so as to avoid any collision occurred during the transportation of the display panel 40. The two second containing grooves 332 are disposed on the top of the two cushions 33 for wrapping a base 42 of the flat panel television, such that the display panel 40 and the base 42 of the flat panel television can be packed simultaneously into the external box 3 to reduce the volume of the packaging structure.

Referring to FIGS. 2 and 3 for a preferred embodiment of the present invention, the lower box 31 is comprised of a box body 311 and two chunks 313, wherein the box body 311 is accommodated at the bottom in the external box 3 and attached onto the lateral surfaces of the external box 3, and the box body 311 is made of a paper cardboard, and the two chunks 313 are disposed inside the box body 311 at both ends thereof, and the top of each chunks 313 has a hollow groove 315 for accommodating the junction of the top and both lateral sides of the display panel 40, so as to prevent the top of the display panel 40 from being hit or collided. The structure of the lower box 31 not only reduces the consumption of a foam or styrofoam material, but also complies with the requirements and regulations of the environmental protection law.

In the embodiment as shown in FIG. 2, the lateral side of the external box 3 proximate to the bottom of the external box 3 includes a plurality of openings 37 corresponding to a plurality of other openings 317 disposed on the box body 31, and the other openings 317 correspond to a plurality of latch grooves 319 disposed on the lateral sides of the two chunks 313 in the lower box 31. The packaging structure further includes a plurality of fasteners 35 disposed on the lateral sides of the external box 3 and passed sequentially through the opening 37 and other openings 317 and latched into the latch groove 319, so that each fastener 35 is passed through the external box 3 and connected to the lower box 31, and the lower box 31 is fixed to the bottom of the external box 3 to secure the flat panel display in the external box 3 for the transportation.

Figure 4:
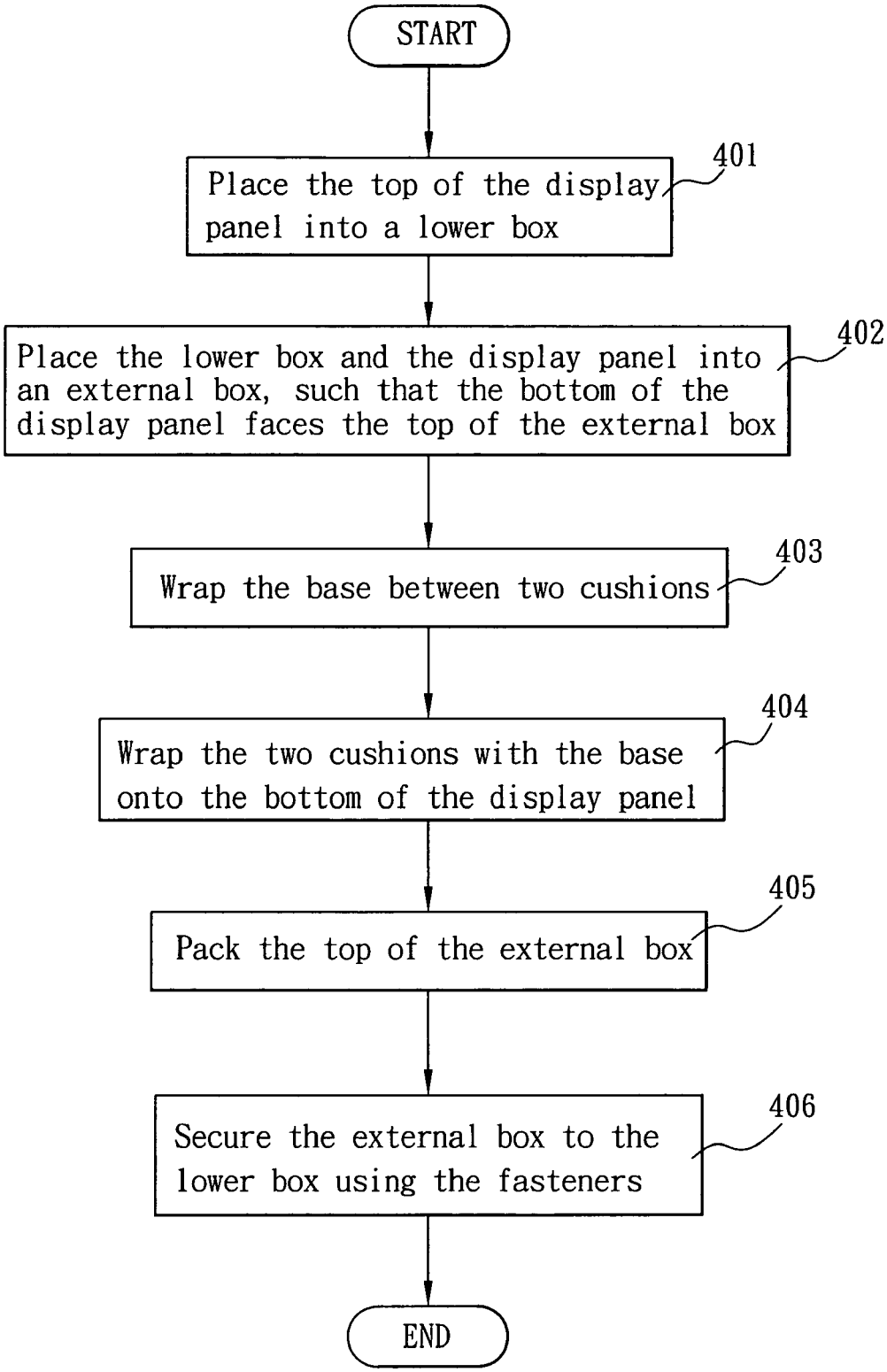
FIG. 4 is a flow chart of a packing method of the present invention.

Referring to FIG. 4 for a method of packing a flat panel display in accordance with a preferred embodiment of the present invention, the flat panel display comprises a display panel 40 and a base 42, and the method for packing the display panel 40 and the base 42 comprises the steps of:

(401) Placing the top of the display panel 40 into a lower box 31;

(402) Placing the lower box 31 and the display panel 40 into an external box 3, and the display panel 40 is placed upside down in the external box 3, such that the bottom of the display panel 40 faces the top of the external box 3;

(403) Wrapping the base 42 between the two cushions 33;

(404) Wrapping two cushions 33 with the base 42 onto the bottom of the display panel 40, such that the display panel 40 can be secured in the external box 3 and maintains an interval from the external box 3; and (405) Pack the top of the external box 3, so that the display panel 40 and the base 42 of the flat panel display can be packed simultaneously into the external box 3.

(406) Secure the external box 3 to the lower box 31 using the fasteners 35.

Figure 5:
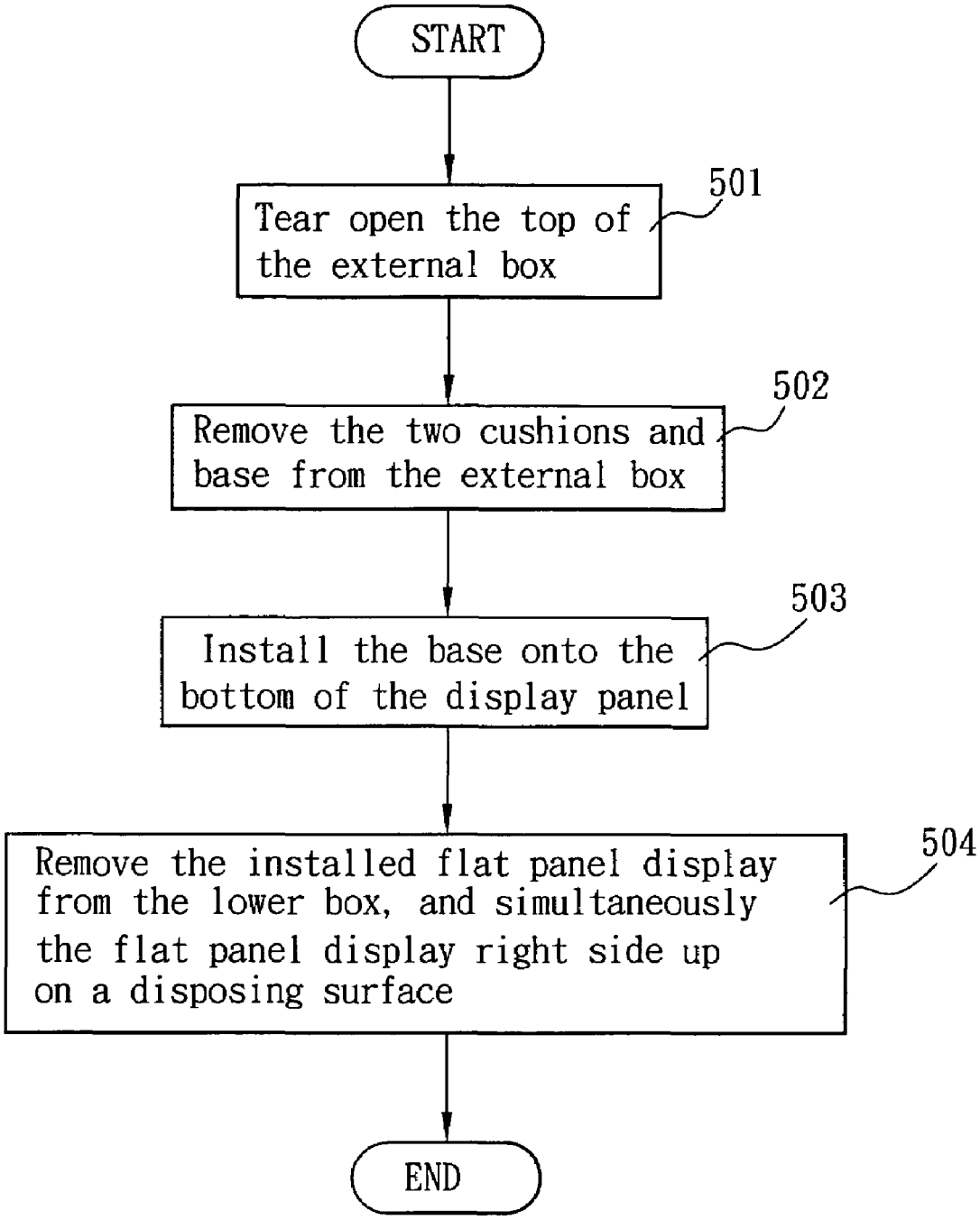
FIG. 5 is a flow chart of an unpacking method of the present invention.

Referring to FIG. 5 for a method of packing and unpacking a flat panel television according to another preferred embodiment of the present invention, this method comprises the following steps if a user wants to open the top of a sealed external box 3:

(501) Tear open the top of the external box 3;

(502) Remove the two cushions 33 and base 42 from the external box 3;

(503) Install the base 42 onto the bottom of the display panel 40 to complete the installation of the flat panel display; and (504) Remove the installed flat panel display from the lower box 31 in the external box 3, and simultaneously turn the flat panel display right side upon a disposing surface.

Figure 6:
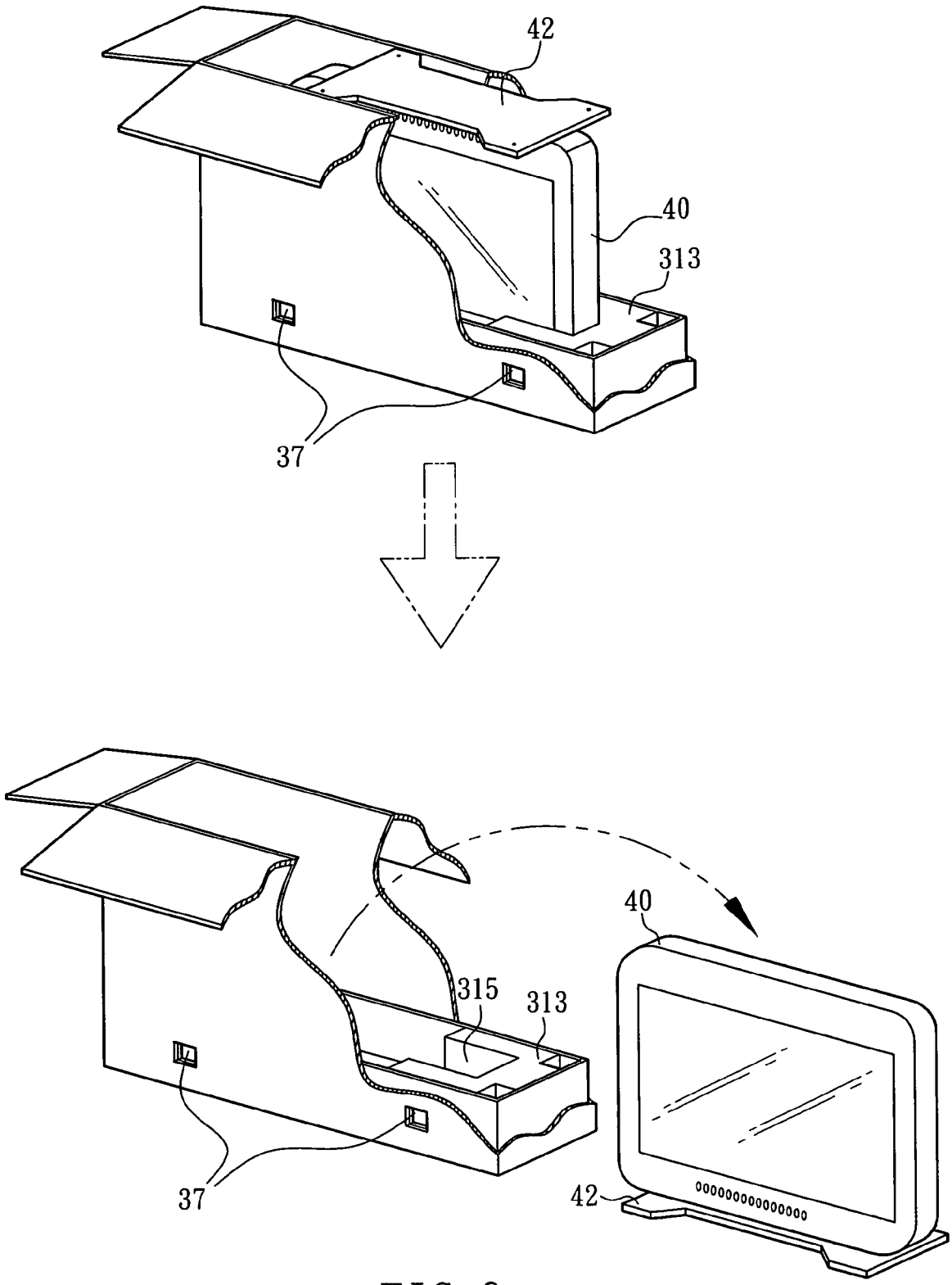
FIG. 6 is a schematic view of unpacking a flat panel display of the present invention.

The structure and method for packing a flat panel television in accordance with the present invention not only pack the display panel 40 and the base 42 simultaneously into the packaging structure, but also reduce the volume of the packaging structure and packing material. The invention definitely can lower costs and meet the environmental protection requirement for reducing the consumption of related packing materials over the conventional carton structure. If a consumer wants to unpack the carton of the flat panel television as shown in FIG. 6, the two cushions 33 and the base 42 will be removed from the bottom of the display panel 40 first, and then the consumer will be able to attach the base 42 onto the bottom of the display panel 40 easily, because the display panel 40 can be placed on a flat surface by turning the lower box 31 upside down. After the base 42 is attached onto the bottom of the display panel 40, the consumer can remove the installed flat panel television from the lower box 31 in the external box 3 and turn the direction of the flat panel television to set the flat panel television at an appropriate position. Such arrangement not only reduces the number of times of placing the display panel, but also achieves the effects of avoiding possible scratches to the display panel 40, shortening the installation time, and simplifying the packing and unpacking procedure of the flat panel television.

While the invention herein disclosed has been described by means of specific embodiments, numerous modifications and variations could be made thereto by those skilled in the art without departing from the scope and spirit of the invention set forth in the claims.

What is claimed is:

1. A packaging structure, for packing a flat panel display including a display panel and a base detachable from each other, comprising:

an external box, having a plurality of first openings disposed on at least one lateral side of the external box adjacent to a bottom side of the external box;

a lower box, disposed at the bottom inside the external box and having a plurality of second openings disposed on at least one lateral side of the lower box adjacent to a bottom side of the lower box, wherein the second openings are disposed at positions corresponding to the first openings and the bottom of the lower box is provided for wrapping the top of the display panel; and two cushions, installed at the top inside the external box and each having a first containing groove and a second containing groove, wherein the first containing groove is disposed at the bottom of the cushion and covers onto the bottom of the display panel and the second containing groove is disposed on the top of the cushion for wrapping the base; and a plurality of fasteners, each disposed on the lateral side of the external box and passing through the corresponding first opening and second opening sequentially for securing the lower box to the bottom inside the external box.

2. The packaging structure of claim 1, wherein the lower box comprises:

a box body, accommodated at the bottom of the external box and having the second openings disposed on at least one lateral side of the box body adjacent to a bottom side of the box body; and two chunks, disposed inside the box body at both ends thereof and each having a plurality of latch grooves disposed on at least one lateral side of the adjacent to a bottom side of the chunk and a hollow groove disposed at a top side of the chunk for accommodating the top of the display panel, wherein each of the latch groove is disposed at a position corresponding to the second opening and is latched with the fastener through the corresponding first opening and second opening.

* * * * *